US011286434B2

(12) United States Patent
Choi

(10) Patent No.: US 11,286,434 B2
(45) Date of Patent: Mar. 29, 2022

(54) CONVERSION PROCESS USING SUPERCRITICAL WATER

(71) Applicant: Saudi Arabian Oil Company, Dhahran (SA)

(72) Inventor: Ki-Hyouk Choi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 191 days.

(21) Appl. No.: 15/905,278

(22) Filed: Feb. 26, 2018

(65) Prior Publication Data

US 2019/0264113 A1 Aug. 29, 2019

(51) Int. Cl.

| | |
|---|---|
| ***C10G 55/04*** | (2006.01) |
| ***C10G 47/02*** | (2006.01) |
| ***C10G 29/22*** | (2006.01) |
| ***C10G 29/24*** | (2006.01) |

(52) U.S. Cl.

CPC ..... *C10G 55/04* (2013.01); *C10G 29/22* (2013.01); *C10G 29/24* (2013.01); *C10G 47/02* (2013.01); *C10G 2300/4006* (2013.01); *C10G 2300/805* (2013.01)

(58) Field of Classification Search

CPC ..... C10G 29/22; C10G 29/24; C10G 47/02; C10G 55/04

See application file for complete search history.

(56) References Cited

U.S. PATENT DOCUMENTS

| | | | |
|---|---|---|---|
| 4,370,223 | A | 1/1983 | Bose |
| 7,264,710 | B2 | 9/2007 | Hokari et al. |
| 7,435,330 | B2 | 10/2008 | Hokari et al. |
| 7,931,711 | B2 | 4/2011 | Wootton et al. |
| 9,051,521 | B2 | 6/2015 | Yarbro |

(Continued)

FOREIGN PATENT DOCUMENTS

| | | | |
|---|---|---|---|
| EP | 0423960 | A1 | 4/1991 |
| WO | 2014156382 | A1 | 10/2014 |
| WO | 2015094948 | A1 | 6/2015 |

OTHER PUBLICATIONS

Soto, et al., Upgrading of asphalt with and without partial oxidation in supercritical water, Fuel 82 (2003) 1231-1239.

(Continued)

*Primary Examiner* — Prem C Singh
*Assistant Examiner* — Brandi M Doyle
(74) *Attorney, Agent, or Firm* — Bracewell LLP; Constance Gall Rhebergen

(57) ABSTRACT

A process for upgrading a heavy oil, the process comprising the steps of introducing a heavy oil feed to a partial oxidation unit; introducing a water feed to a partial oxidation unit; introducing an oxidant feed to a partial oxidation unit, where the oxidant feed comprises an oxidant; processing the heavy oil feed, the water feed, and the oxidant feed in the partial oxidation unit to produce a liquid oxidation product, where the liquid oxidation product comprises oxygenates; introducing the liquid oxidation product to a supercritical water unit; introducing a water stream to the supercritical water unit; and processing the liquid oxidation product and the water stream in the supercritical water unit to produce an upgraded product stream, the upgraded product stream comprising upgraded hydrocarbons relative to the heavy oil feed.

12 Claims, 3 Drawing Sheets

(56) References Cited

U.S. PATENT DOCUMENTS

| | | | | |
|---|---|---|---|---|
| 2004/0232046 | A1 | 11/2004 | Tanaka et al. | |
| 2009/0032436 | A1 | 2/2009 | Takahashi et al. | |
| 2009/0145805 | A1 | 6/2009 | Choi | |
| 2011/0147266 | A1* | 6/2011 | Choi | C10G 27/04 208/85 |
| 2011/0315600 | A1 | 12/2011 | Choi et al. | |
| 2014/0109465 | A1 | 4/2014 | Coppola et al. | |
| 2014/0135540 | A1 | 5/2014 | Iversen | |
| 2016/0060550 | A1* | 3/2016 | Francisco | C10G 67/12 208/7 |
| 2016/0272901 | A1* | 9/2016 | Choi | C10G 47/32 |

OTHER PUBLICATIONS

Watanabe, et al., Partial oxidation of n-hexadecane and polyethylene in supercritical water, The Journal of Supercritical Fluids, 20 (2001), 257-266.

International Search Report and Written Opinion for related PCT application PCT/US2019/019504 dated May 16, 2019. (SA5841).

Yan et al., "A review of upgrading heavy oils with supercritical fluids", The Royal Society of Chemistry, 2015, pp. 75129-75140.

* cited by examiner

CONVERSION PROCESS USING SUPERCRITICAL WATER

TECHNICAL FIELD

Disclosed are methods for upgrading petroleum. Specifically, disclosed are methods and systems for upgrading petroleum using pretreatment processes.

BACKGROUND

Supercritical water processes can upgrade heavy oil through radical-mediated reaction routes, where chemical bonds are broken by thermal energy and the cage effect exerted by supercritical water prevents coke formation. However, harsh operation conditions, such as high temperature and long residence times, are required to reach deep conversion of heavy oil. In conventional hydrocracking, deep conversion can refer to conversion of the vacuum residue between 50% and 90% but at the sacrifice of large amounts of hydrogen and a short life time of the catalyst. These harsh conditions generate large amounts of gas product as well as coke material. The increased production of gas product results in a loss of liquid yield. In supercritical water processes, deep conversion can be achieved by increasing the temperature and residence time, which can also increase the amount of coke production which results in a reduced process time due to plugging.

SUMMARY

Disclosed are methods for upgrading petroleum. Specifically, disclosed are methods and systems for upgrading petroleum using pretreatment processes.

In a first aspect, a process for upgrading a heavy oil is provided. The process includes the steps of introducing a heavy oil feed to a partial oxidation unit, introducing a water feed to a partial oxidation unit, introducing an oxidant feed to a partial oxidation unit, where the oxidant feed includes an oxidant, processing the heavy oil feed, the water feed, and the oxidant feed in the partial oxidation unit to produce a liquid oxidation product, where the liquid oxidation product includes oxygenates, introducing the liquid oxidation product to a supercritical water unit, introducing a water stream to the supercritical water unit, and processing the liquid oxidation product and the water stream in the supercritical water unit to produce an upgraded product stream, the upgraded product stream includes upgraded hydrocarbons relative to the heavy oil feed.

In certain aspects, the process further includes the steps of increasing the pressure of the heavy oil feed in a feed pump to produce pressurized oil feed, introducing the pressurized oil feed to a feed heater, increasing the temperature of the pressurized oil feed in the feed heater to produce a hot oil feed, mixing the water feed and the oxidant feed in a premixer to produce a mixed oxidant feed, introducing the mixed oxidant feed to an oxidant pump, increasing the pressure of the mixed oxidant feed in the oxidant pump to produce a pressurized oxidant feed, introducing the pressurized oxidant feed to a oxidant heater, increasing the temperature of pressurized oxidant feed to produce a hot oxidant feed, mixing the hot oil feed and the hot oxidant feed in an oxidation mixer to produce to produce a mixed oxidation feed, introducing mixed oxidation feed to an oxidation reactor, allowing the mixed oxidation feed to undergo oxidation reactions in the oxidation reactor to produce a reactor effluent, introducing the reactor effluent to an effluent cooler, reducing the temperature in the effluent cooler to produce a cooled effluent, introducing the cooled effluent to an effluent depressurizing device, and decreasing the pressure of the cooled effluent in the effluent depressurizing device to produce a depressurized effluent, introducing the depressurized effluent to a separator, and separating the depressurized effluent in the separator to produce a gas oxidation product and the liquid oxidation product, where the gas oxidation product includes unreacted oxidants.

In certain aspects, the process further includes the steps of increasing the pressure of the liquid oxidation product in a pump to produce a pressurized stream, introducing the pressurized stream to a heater, increasing the temperature of the pressurized stream in the heater to produce a hot stream, increasing the pressure of the water stream in a water pump to produce a pressurized water stream, introducing the pressurized water stream to a water heater, increasing the temperature of the pressurized water stream in the water heater to produce a supercritical water stream, mixing the hot stream and the supercritical water stream in a mixer to produce a mixed stream, introducing the mixed stream to a supercritical water reactor, allowing the hydrocarbons to undergo a set of conversion reactions in the supercritical water reactor to produce a reactor product, introducing the reactor product to a product cooler, reducing the temperature of the reactor product to produce a cooled product, introducing the cooled product to a depressurizing device, reducing the pressure of the cooled product in the depressurizing device to produce a depressurized stream, introducing the depressurized stream to a vapor-liquid separator to produce a gas product stream and a liquid stream, introducing the liquid stream to an oil-water separator, and separating the liquid stream in the oil-water separator to produce the upgraded product stream and a used water stream.

In certain aspects, the heavy oil feed is selected from the group consisting of petroleum, coal liquid, or biomaterials, and combinations of the same. In certain aspects, the oxidant is selected from the group consisting of air, oxygen gas, hydrogen peroxide, organic peroxides, and combinations of the same. In certain aspects, a molar ratio of oxygen atoms in the oxidant feed to carbon atoms in the heavy oil feed is between 0.0007 and 0.05. In certain aspects, the oxygenates are selected from alcohols, ketones, esters, ethers, carboxylic acids, and combinations of the same. In certain aspects, a temperature of the oxidation reactor is between 150 deg C. and 374 deg C., and where a pressure is between 0.5 MPa and 35 MPa, such that water in the oxidation reactor is present in the liquid phase. In certain aspects, a liquid hourly space velocity is in the range between 1 hr-1 and 10 hr-1. In certain aspects, the oxidation reactor includes an oxidation catalyst, where the oxidation catalyst includes an active component. In certain aspects, a ratio of a volumetric flow rate of the supercritical water stream to the hot stream is in the range between 1.1:1 and 5:1. In certain aspects, a temperature of the supercritical water reactor is in the range between 380 deg C. and 500 deg C.

In second aspect, a system for upgrading a heavy oil feed is provided. The system includes a partial oxidation unit, the partial oxidation unit configured to process the heavy oil feed, a water feed, and an oxidant feed to produce a liquid oxidation product, where the oxidant feed includes an oxidant, where the liquid oxidation product includes oxygenates, a supercritical water unit fluidly connected to the partial oxidation unit, the supercritical water unit configured to process the liquid oxidation product and a water stream to produce an upgraded product stream, the upgraded product stream includes upgraded hydrocarbons relative to the heavy oil feed.

In certain aspects, the system further includes a feed pump, the feed pump configured to increase a pressure of the heavy oil feed to produce pressurized oil feed, a feed heater fluidly connected to the feed pump, the feed heater configured to increase a temperature of the pressurized oil feed to produce a hot oil feed, a premixer, the premixer configured to mix the water feed and the oxidant feed to produce a mixed oxidant feed, an oxidant pump fluidly connected to the premixer, the oxidant pump configured to increase the pressure of the mixed oxidant feed to produce a pressurized oxidant feed, an oxidant heater fluidly connected to the oxidant pump, the oxidant heater configured to increase the temperature of the pressurized oxidant feed to produce a hot oxidant feed, an oxidation mixer fluidly connected to the feed heater and the oxidant heater, the oxidation mixer configured to mix the hot oil feed and the hot oxidant feed to produce to produce a mixed oxidation feed, an oxidation reactor fluidly connected to the oxidation mixer, the oxidation reactor configured to allow the mixed oxidation feed to undergo oxidation reactions to produce a reactor effluent, an effluent cooler fluidly connected to the oxidation reactor, the effluent cooler configured to reduce the temperature of the reactor effluent to produce a cooled effluent, an effluent depressurizing device fluidly connected to the effluent cooler, the effluent depressurizing device configured to reduce the pressure of the cooled effluent to produce a depressurized effluent, and a separator fluidly connected to the effluent depressurizing device, the separator configured to separate the depressurized effluent to produce a gas oxidation product and the liquid oxidation product, where the gas oxidation product includes unreacted oxidants.

In certain aspect, the system further includes a pump, the pump configured to increase the pressure of the liquid oxidation product to produce a pressurized stream, a heater fluidly connected to the pump, the heater configured to increase the temperature of the pressurized stream in the heater to produce a hot stream, a water pump, the water pump configured to increase the pressure of the water stream to produce a pressurized water stream, a water heater fluidly connected to the water pump, the water heater configured to increase the temperature of the pressurized water stream to produce a supercritical water stream, a mixer fluidly connected to the heater and the water heater, the mixer configured to mix the hot stream and the supercritical water stream to produce a mixed stream, where the mixed stream includes hydrocarbons, a supercritical water reactor fluidly connected to the mixer, the supercritical water reactor configured to allow the hydrocarbons to undergo a set of conversion reactions to produce a reactor product, a product cooler fluidly connected to the supercritical water reactor, the product cooler configured to reduce the temperature of the reactor product to produce a cooled product, a depressurizing device fluidly connected to the product cooler, the depressurizing device configured to reduce the pressure of the cooled product to produce a depressurized stream, a vapor-liquid separator fluidly connected to the depressurizing device, the vapor-liquid separator to produce a gas product stream and a liquid stream, and an oil-water separator fluidly connected to the vapor-liquid separator, the oil-water separator configured to separate the liquid stream to produce the upgraded product stream and a used water stream.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

Figure 1:
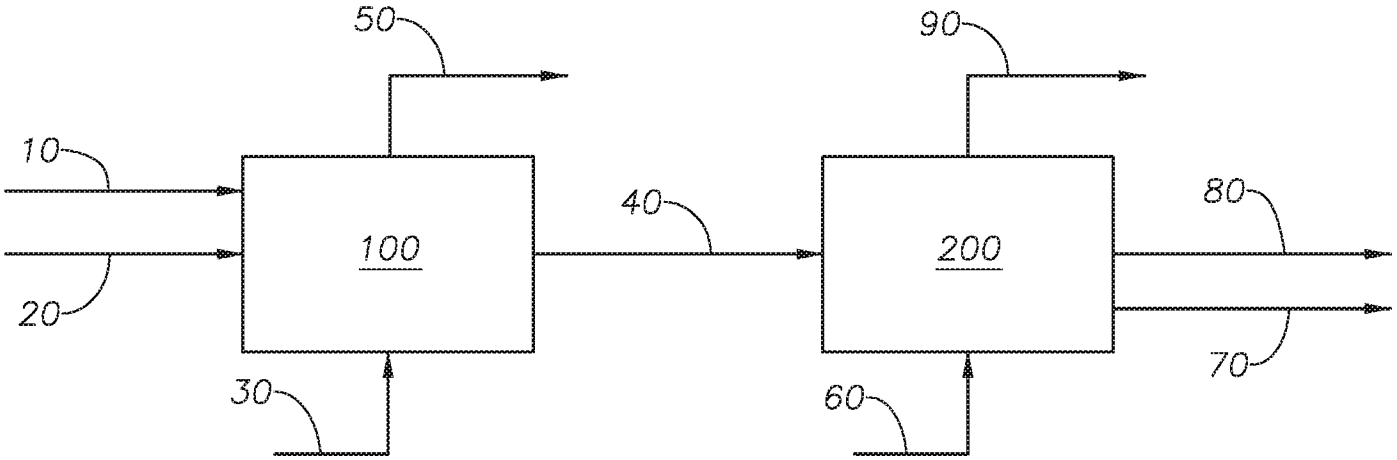
FIG. 1 provides a process diagram of an embodiment of the process.

In the accompanying Figures, similar components or features, or both, may have a similar reference label.

DETAILED DESCRIPTION

While the scope of the apparatus and method will be described with several embodiments, it is understood that one of ordinary skill in the relevant art will appreciate that many examples, variations and alterations to the apparatus and methods described here are within the scope and spirit of the embodiments.

Accordingly, the embodiments described are set forth without any loss of generality, and without imposing limitations, on the embodiments. Those of skill in the art understand that the scope includes all possible combinations and uses of particular features described in the specification.

The processes and systems described are directed to upgrading heavy oil feedstocks. The processes and systems described include partially oxidizing a heavy oil feedstock to produce oxygenates such as alcohol, ether, ester, and carboxylic compounds. Advantageously, the process order of partial oxidation unit followed by supercritical water unit results in improved performance of heavy oil upgrading in supercritical water unit. Advantageously, the partial oxidation unit provides a method of pretreating a heavy oil to generate carbon-oxygen bonds which can be broken in the supercritical water unit. Advantageously, the removal of gases formed in the partial oxidation unit can increase the efficiency of the system by reducing the potential for damage in the pump due to cavitation brought on by pumping gas-containing liquid. The presence of oxygen and other gases in the supercritical water unit can increase the amount of gas produced in the supercritical water unit while decreasing the liquid yield, thus, removing gases upstream of the supercritical water unit increases the liquid yield. Advantageously, the removal of solid particulates following the partial oxidation unit reduces the production of coke in the supercritical water unit. Advantageously, the upgrading process with partial oxidation pretreatment can increase the production of naphtha fraction and gas oil fractions in an upgraded product from the supercritical water unit, which can increase the API gravity. Advantageously, partial oxidation upstream of thermal cracking in supercritical water enhances overall liquid yield as compared to total oxidation and enhances conversion of heavy fractions and desulfurization reactions, denitrogenation reactions, and demetallization reactions. Advantageously, employing the partial oxidation unit upstream of the supercritical water unit reduces the amount of heat to be supplied to supercritical water reactor.

It is known in the art that hydrocarbon reactions in supercritical water upgrade heavy oil and crude oil containing sulfur compounds to produce products that have lighter fractions. Supercritical water has unique properties making it suitable for use as a petroleum reaction medium where the reaction objectives can include conversion reactions, desulfurization reactions denitrogenation reactions, and demetallization reactions. Supercritical water is water at a temperature at or greater than the critical temperature of water and at a pressure at or greater than the critical pressure of water. The critical temperature of water is 373.946° C. The critical pressure of water is 22.06 megapascals (MPa). Advantageously, at supercritical conditions water acts as both a hydrogen source and a solvent (diluent) in conversion reactions, desulfurization reactions and demetallization reactions and a catalyst is not needed. Hydrogen from the water molecules is transferred to the hydrocarbons through direct transfer or through indirect transfer, such as the water-gas shift reaction. In the water-gas shift reaction, carbon monoxide and water react to produce carbon dioxide and hydrogen. The hydrogen can be transferred to hydrocarbons in desulfurization reactions, demetallization reactions, denitrogenation reactions, and combinations of the same. The hydrogen can also reduce the olefin content.

Without being bound to a particular theory, it is understood that the basic reaction mechanism of supercritical water mediated petroleum processes is the same as a free radical reaction mechanism. Radical reactions include initiation, propagation, and termination steps. With hydrocarbons, especially heavy molecules such as $C_{10+}$, initiation is the most difficult step and conversion in supercritical water can be limited due to the high activation energy required for initiation. Initiation requires the breaking of chemical bonds. The bond energy of carbon-carbon bonds is about 350 kJ/mol, while the bond energy of carbon-hydrogen is about 420 kJ/mol. Due to the chemical bond energies, carbon-carbon bonds and carbon-hydrogen bonds do not break easily at the temperatures in a supercritical water process, 380 deg C. to 450 deg C., without catalyst or radical initiators. In contrast, aliphatic carbon-sulfur bonds have a bond energy of about 250 kJ/mol. The aliphatic carbon-sulfur bond, such as in thiols, sulfide, and disulfides, has a lower bond energy than the aromatic carbon-sulfur bond.

Thermal energy creates radicals through chemical bond breakage. Supercritical water creates a "cage effect" by surrounding the radicals. The radicals surrounded by water molecules cannot react easily with each other, and thus, intermolecular reactions that contribute to coke formation are suppressed. The cage effect suppresses coke formation by limiting inter-radical reactions. Supercritical water, having low dielectric constant, dissolves hydrocarbons and surrounds radicals to prevent the inter-radical reaction, which is the termination reaction resulting in condensation (dimerization or polymerization). Because of the barrier set by the supercritical water cage, hydrocarbon radical transfer is more difficult in supercritical water as compared to conventional thermal cracking processes, such as delayed coker, where radicals travel freely without such barriers.

Sulfur compounds released from sulfur-containing molecules can be converted to $H_2S$, mercaptans, and elemental sulfur. Without being bound to a particular theory, it is believed that hydrogen sulfide is not "stopped" by the supercritical water cage due its small size and chemical structure similar to water ($H_2O$). Hydrogen sulfide can travel freely through the supercritical water cage to propagate radicals and distribute hydrogen. Hydrogen sulfide can lose its hydrogen due to hydrogen abstraction reactions with hydrocarbon radicals. The resulting hydrogen-sulfur (HS) radical is capable of abstracting hydrogen from hydrocarbons which will result in formation of more radicals. Thus, $H_2S$ in radical reactions acts as a transfer agent to transfer radicals and abstract/donate hydrogen.

As previously noted, aromatic sulfur compounds are more stable in supercritical water compared to more active aliphatic sulfur compounds. As a result, a feedstock having more aliphatic sulfur can have a higher activity in the early stage of thermal cracking in supercritical water. However, the amount of aliphatic sulfur in heavy oil feedstocks is insufficient to increase conversion of heavy oil at temperatures limited to 450 deg C. and residence time of less than 10 minutes.

Aliphatic sulfur compounds are generally found in light naphtha and vacuum residue. In vacuum residue, aliphatic carbon-sulfur bonds are believed to be present in asphalthenic fraction. The amount of aliphatic sulfur compounds is less than aromatic sulfur compounds in common crude oils.

As used throughout, "external supply of hydrogen" refers to the addition of hydrogen to the feed to the reactor or to the reactor itself. For example, a reactor in the absence of an external supply of hydrogen means that the feed to the reactor and the reactor are in the absence of added hydrogen, gas ($H_2$) or liquid, such that no hydrogen (in the form $H_2$) is a feed or a part of a feed to the reactor.

As used throughout, "external supply of catalyst" refers to the addition of catalyst to the feed to the reactor or the presence of a catalyst in the reactor, such as a fixed bed catalyst in the reactor. For example, a reactor in the absence of an external supply of catalyst means no catalyst has been added to the feed to the reactor and the reactor does not contain a catalyst bed in the reactor.

As used throughout, "external supply of oxidants" refers to the addition of oxidants to the feed to the reactor or the addition of oxidants as a separate feed to a reactor. For example, a reactor in the absence of an external supply of oxidants means no oxidants have been added to the feed to the reactor in the form of a separate oxidant stream and the reactor does not contain a catalyst bed in the reactor As used throughout, "atmospheric residue" or "atmospheric residue fraction" refers to the fraction of oil-containing streams having a T10% of 650 deg F., such that 90% of the volume of hydrocarbons have boiling points greater than 650 deg F. and includes the vacuum residue fraction. Atmospheric residue can refer to the composition of an entire stream, such as when the feedstock is from an atmospheric distillation unit, or can refer to a fraction of a stream, such as when a whole range crude is used.

As used throughout, "vacuum residue" or "vacuum residue fraction" refers to the fraction of oil-containing streams having a T10% of 1050 deg F. Vacuum residue can refer to the composition of an entire stream, such as when the feedstock is from a vacuum distillation unit or can refer to a fraction of stream, such as when a whole range crude is used.

As used throughout, "asphaltene" refers to the fraction of an oil-containing stream which is not soluble in a n-alkane, particularly, n-heptane.

As used throughout, "coke" refers to the toluene insoluble material present in petroleum.

As used throughout, "cracking" refers to the breaking of hydrocarbons into smaller ones containing few carbon atoms due to the breaking of carbon-carbon bonds.

As used throughout, "upgrade" means one or all of increasing API gravity, decreasing the amount of impurities, such as sulfur, nitrogen, and metals, decreasing the amount of asphaltene, and increasing the amount of distillate in a process outlet stream relative to the process feed stream. One of skill in the art understands that upgrade can have a relative meaning such that a stream can be upgraded in comparison to another stream, but can still contain undesirable components such as impurities.

As used here, "conversion reactions" refers to reactions that can upgrade a hydrocarbon stream including cracking, isomerization, alkylation, dimerization, aromatization, cyclization, desulfurization, denitrogenation, deasphalting, and demetallization.

As used here, "partial oxidation" refers to oxidation reactions where the amount of oxygen present is limited, such that the extent of oxidation reactions is limited. While the carbons and heteroatoms present are subjected to the oxidation environment, in partial oxidation not all the carbons are transformed to carbon dioxide, unlike in a total oxidation environment. The extent of oxidation depends on the amount of oxygen present, the temperature, residence time, and catalyst in the oxidation reactor.

As used here, "deep conversion," a qualitative term, refers to the conversion of vacuum residue to greater than 50%, and alternately greater than 70% in the absence of an external supply of hydrogen and in the absence of an external supply of catalyst.

As used here, "gas-to-liquid processes" or "GTL processes" refer to processes to convert natural gas to liquid hydrocarbons, such as gasoline and diesel. An example of a GTL process is one with a Fischer-Tropsch reaction. Hydrocarbons produced in a GTL process can result in paraffinic hydrocarbons.

The following embodiments, provided with reference to the figures, describe the upgrading process.

Referring to FIG. 1, a process flow diagram of an upgrading process is provided. Heavy oil feed 10, water feed 20, and oxidant feed 30 can be introduced to partial oxidation unit 100. Heavy oil feed 10 can be from any hydrocarbon source derived from petroleum, coal liquid, or biomaterials. Examples of heavy oil feed 10 include whole range crude oil, distilled crude oil, residue oil, topped crude oil, refinery product streams, product streams from steam cracking processes, liquid hydrocarbons from gas-to-liquid (GTL) processes, liquefied coals, liquid products recovered from oil or tar sands, bitumen, oil shale, asphaltenes, and biomass hydrocarbons. Heavy oil feed 10 can include an oxygen content of less than 1.5 wt % and alternately less than 0.3 wt %. "Whole range crude oil" refers to passivated crude oil which has been processed by a gas-oil separation plant after being recovered from a production well. "Topped crude oil" can also be known as "reduced crude oil" and refers to a crude oil having no light fraction, and would include an atmospheric residue stream or a vacuum residue stream. "Refinery product streams" can include "cracked oil," such as light cycle oil, heavy cycle oil, and streams from a fluid catalytic cracking unit (FCC), such as slurry oil or decant oil, a heavy stream from hydrocracker with a boiling point greater than 650 deg F., a deasphalted oil (DAO) stream from a solvent extraction process, and a mixture of atmospheric residue and hydrocracker bottom fractions.

Water feed 20 can be a demineralized water having a conductivity less than 1.0 microSiemens per centimeter (μS/cm), alternately less 0.5 μS/cm, and alternately less than 0.1 μS/cm. In at least one embodiment, water feed 20 is demineralized water having a conductivity less than 0.1 μS/cm. Water feed 20 can have a sodium content less than 5 micrograms per liter (μg/L) and alternately less than 1 μg/L. Water feed 20 can have a chloride content less than 5 μg/L and alternately less than 1 μg/L. Water feed 20 can have a silica content less than 3 μg/L.

Oxidant feed 30 can be an oxidant-containing stream. Oxidants can include air, oxygen gas, hydrogen peroxide, organic peroxides, and combinations of the same. Oxidant feed 30 can include an aqueous fluid when the oxidant is hydrogen peroxide, organic peroxide, and combinations of the same. The aqueous fluid can include water. The concentration of oxidants in oxidant feed 30 can be adjusted and controlled to regulate the molar ratio of oxygen atoms in oxidant feed 30 to the carbon atoms in heavy oil feed 10. The molar ratio of oxygen atoms in oxidant feed 30 to carbon atoms in heavy oil feed 10 can be in the range between 0.0007 and 0.05, 0.005 and 0.1 and alternately between 0.01 and 0.04. Advantageously, adjusting the concentration of oxidants in oxidant feed 30 to achieve the molar ratio range of oxygen atoms to carbon atoms can reduce the amount of gas products formed in partial oxidation unit 100. Reducing the amount of gas products, increases the liquid yield from the partial oxidation unit 100 and supercritical upgrading unit 200.

Heavy oil feed 10, water feed 20, and oxidant feed 30 can be processed in partial oxidation unit 100 to produce liquid oxidation product 40 and gas oxidation product 50. Gas oxidation product 50 can be sent for further treatment or to be disposed. In at least one embodiment, oxidation product 50 can be sent to a flare stack to be disposed. Liquid oxidation product 40 can be introduced to supercritical upgrading unit 200 along with water stream 60.

Water stream 60 can be a demineralized water having a conductivity less than 1.0 microSiemens per centimeter (μS/cm), alternately less 0.5 μS/cm, and alternately less than 0.1 μS/cm. In at least one embodiment, water feed 20 is demineralized water having a conductivity less than 0.1 μS/cm. Water feed 20 can have a sodium content less than 5 micrograms per liter (μg/L) and alternately less than 1 μg/L. Water stream 60 can have a chloride content less than 5 μg/L and alternately less than 1 μg/L. Water stream 60 can have a silica content less than 3 μg/L. Water stream 60 can be from the same source as water feed 20, and alternately from a different source as water feed 20.

Liquid oxidation product 40 and water stream 60 can be processed in supercritical upgrading unit 200 to produce used water stream 70, upgraded product stream 80, and gas product 90. Upgraded product stream 80 can contain upgraded hydrocarbons relative to heavy oil feed 10. The water content in upgraded product stream 80 can be less than 0.3 wt %.

Used water stream 70 can be treated and after treatment, can be disposed or recycled to the front end of the partial oxidation unit as the water feed or can be recycled to the supercritical water unit as the water stream. In at least one embodiment, treatment of used water stream 70 can include passing used water stream 70 through a reverse osmosis membrane.

Figure 2:
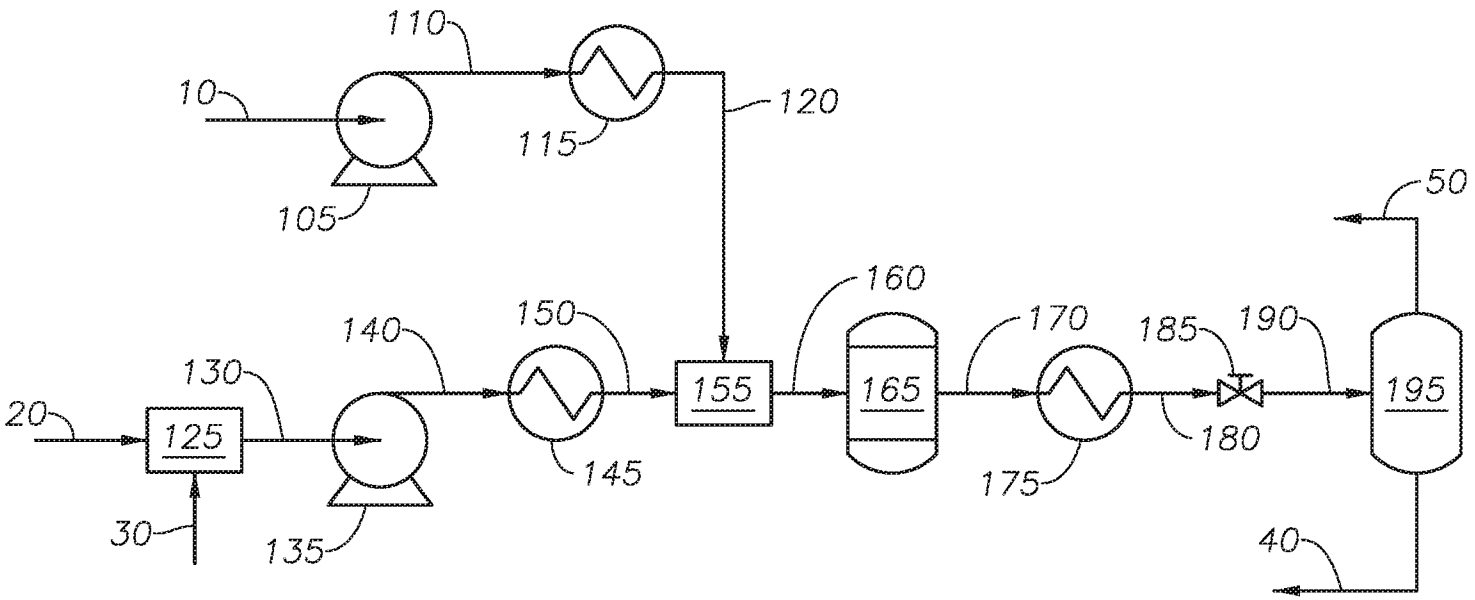
FIG. 2 provides a process diagram of an embodiment of the partial oxidation unit.

Partial oxidation unit 100 can be described with reference to FIG. 2.

Heavy oil feed 10 can be introduced to feed pump 105. The pressure of heavy oil feed 10 can be increased in feed pump 105 to produce pressurized oil feed 110. Feed pump 105 can be any type of pump capable of increasing the pressure of a heavy oil stream. Examples of feed pump 105 can include a metering pump, such as a diaphragm pump. The pressure of pressurized oil feed 100 can be between 0.5 MPa and 35 MPa and alternately between 5 MPa and 22 MPa. Pressurized oil feed 110 can be introduced to feed heater 115.

The temperature of pressurized oil feed 110 can be increased in feed heater 110 to produce hot oil feed 120. Feed heater 115 can be any type of heat exchanger capable of increasing the temperature of a heavy oil stream.

Examples of feed heater 115 include shell and tube exchangers, double pipe type heat exchangers, plate-fin type heat exchangers. The temperature of hot oil feed 120 can be between 50 deg C. and 350 deg C. and alternately between 100 deg C. and 150 deg C. Hot oil feed 120 can be introduced to oxidation mixer 155.

Water feed 20 and oxidant feed 30 can be introduced to premixer 125 to produce mixed oxidant feed 130. Premixer 125 can be selected from a simple mixer, a tank with impeller, and combinations of the same. Water feed 20 and oxidant feed 30 can be mixed in premixer 125 to produce mixed oxidant feed 130. In embodiments in which the oxidant in oxidant feed 30 is oxygen gas or air, the oxygen content in mixed oxidant feed 130 can be controlled by the temperature and pressure in premixer 125. The residence time in premixer 125 can be sufficient to decompose the oxidant to produce oxygen. By way of example, when the oxidant is hydrogen peroxide, the residence time in premixer 125 can be sufficient to decompose hydrogen peroxide to water and oxygen. The residence time in premixer 125 can be between 10 second and 1 minute. In at least one embodiment, premixer 125 can enable removal of undissolved gases. In at least one embodiment, removal of undissolved gases can be achieved through venting. Undissolved gases can include the oxygen gas or air that does not get mixed in mixed oxidant feed 130. Mixed oxidant feed 130 can be introduced to oxidant pump 135.

The pressure of mixed oxidant feed 130 can be increased in oxidant pump 135 to produce pressurized oxidant feed 140. Oxidant pump 135 can be any type of pump capable of increasing the pressure of an aqueous fluid. Examples of oxidant pump 135 can include a metering pump, such as a diaphragm pump. The pressure of pressurized oxidant feed 140 can be between 0.5 MPa and 35 MPa and alternately between 5 MPa and 22 MPa. Pressurized oxidant feed 140 can be introduced to oxidant heater 145.

The temperature of pressurized oxidant feed 140 can be increased in oxidant heater 145 to produce hot oxidant feed 150. Oxidant heater 145 can be any type of heat exchanger capable of increasing the temperature of an aqueous fluid. Examples of oxidant heater 145 can include a shell and tube exchanger, electric heater, and gas fired heater. The temperature of hot oxidant feed 150 can be between 150 deg C. and 450 deg C. and alternately between 200 deg C. and 360 deg C. Hot oxidant feed 150 can be introduced to oxidation mixer 155. In at least one embodiment, hot oxidant feed 150 can be at supercritical conditions, such that the water in hot oxidant feed 150 is in a supercritical state. In at least one embodiment, hot oxidant feed 150 is at subcritical conditions, such that the water is in liquid state. Hot oxidant feed 150 is at operating conditions such that the water in oxidant feed is a supercritical fluid, or is in the liquid phase and is in the absence of steam.

Oxidation mixer 155 can combine hot oxidant feed 150 and hot oil feed 120 to produce mixed oxidation feed 160. Oxidation mixer 155 can be any type of mixer capable of mixing a heavy oil stream and an aqueous stream. Examples of oxidation mixer 155 can include a line mixer, an agitator, and ultrasonic chamber. The volumetric ratio of water to heavy oil in mixed oxidation feed 160 can be between 1:1 and 10:1 volume by volume (vol/vol) at standard atmospheric temperature and pressure (SATP) and alternately between 1:1 and 5:1 vol/vol SATP. In at least one embodiment, the volumetric ratio of water to heavy oil in mixed oxidation feed 160 can be maintained such that mixed oxidation feed 160 contains a greater amount of water than oil, because maintaining a greater amount of water than oil minimizes the risk of run-away reactions due to the exothermic conditions of the oxidation reactions in oxidation reactor 165. Water can act as a heat sink, to control temperature, in oxidation reactor 165. The volumetric ratio of water to heavy oil in mixed oxidation feed 160 can be controlled to maintain the total oxygen to carbon molar ratio of liquid oxidation product 40.

Mixed oxidation feed 160 can be introduced to oxidation reactor 165. Oxidation reactor 165 can be any type of continuous-type reactor capable of supporting oxidation reactions. In at least one embodiment, paraffins and alkyl chains attached to aromatic cores in the heavy oil are susceptible to oxidation reactions. In at least one embodiment, aromatic and naphthenic rings exhibit stability such that they are not susceptible to oxidation reactions. The oxidation reactions can produce oxygenates, such that reactor effluent 170 can include oxygenates. Oxygenates can include alcohols, ketones, esters, ethers, carboxylic acids, and combinations of the same. In at least one embodiment, the greatest number of oxygenates are ketones having a carbonyl group (carbon double bonded with oxygen). Oxidation reactions differ from hydration reactions, because hydration reactions require a strong acid/base catalyst such as hydrogen sulfide or sodium hydroxide. Moreover, hydration reactions form alcohols alone, whereas oxidation reactions additionally form carboxylic acids and ketones. Examples of oxidation reactor 165 can include a fixed bed reactor and a CSTR type reactor. The temperature in oxidation reactor 165 can be between 150 deg C. and 374 deg C. and alternately between 250 deg C. and 320 deg C. The pressure in oxidation reactor 165 can be between 0.5 MPa and 35 MPa. The operating conditions in oxidation reactor 165 can be controlled such that the water in oxidation reactor 165 can be maintained in a liquid phase.

Oxidation reactor 165 is operated at subcritical conditions, where the water is present in the liquid phase, such that the oxidation reactions result in the partial oxidation of carbon compounds. Due to the high rate of oxygen diffusivity in supercritical water, supercritical water is an efficient medium for oxidation reactions. At supercritical conditions, oxidation reactions can lead to the total oxidation of carbon compounds to carbon dioxide, resulting in loss of liquid. Thus, oxidation reactions in supercritical water conditions can result in a reduced liquid yield as compared to oxidation reactions in subcritical conditions. Additionally, the extent of oxygen incorporation into the heavy oil can be controlled in subcritical conditions to maintain a desired oxygen concentration in the reactor effluent. Controlling the extent of oxygen incorporation is more difficult in supercritical water due to the temperature. Total oxidation of the carbon compounds does not occur in oxidation reactor 165. Heterogeneous catalysts are not stable at supercritical water conditions.

Hydrocarbons in mixed oxidation feed 160 can be upgraded due to the breaking of carbon-to-carbon bonds through oxidation.

Oxidation reactor 165 is in the absence of steam. The residence time in oxidation reactor 165 can be determined based on the extent of oxygen incorporation in the liquid products in the reactor effluent. The residence time measured as the liquid hourly space velocity (LHSV) can be in the range of between 1 per hour ($hr^{-1}$) and 10 $hr^{-1}$ and alternately between 3 $hr^{-1}$ and 6 $hr^{-1}$. In at least one embodiment, oxidation reactor 165 can operate in the absence of an external supply of catalyst. In at least one embodiment, oxidation reactor 165 can contain an oxidation catalyst and be a fixed bed reactor. Oxidation reactor 165 is not a fluidized bed reactor because the operating conditions are such that the water is maintained in the liquid phase, where fluidization is not easy.

Oxidation catalyst can include an active component and alternately an active component in combination with a support. The active component can be include transition metal oxides, precious metals, and lanthanoid oxides. The transition metal oxides can include iron (Fe), nickel (Ni), zinc (Zn), copper (Cu), zirconium, and combinations of the same. The precious metals can include platinum (Pt), gold (Au), silver (Ag) and combinations of the same. The lanthanoid oxide can include lanthium (La) oxide, cerium (Ce) oxide, and combinations of the same. The support can include silicon dioxide ($SiO_2$), aluminum oxide ($Al_2O_3$), zeolites, and combinations of the same.

Reactor effluent 170 can include heavy oil, oxygenates, water, and oxidants. As noted, the total oxygen to carbon molar ratio in reactor effluent 170 can be controlled by adjusting the ratio of oxidant to heavy oil in the mixed oxidation reactor feed to the oxidation reactor, the temperature in the oxidation reactor, the residence time in the oxidation reactor, the catalyst in the oxidation reactor, and combinations of the same.

Reactor effluent 170 can be introduced to effluent cooler 175. The temperature of reactor effluent 170 can be reduced in effluent cooler 175 to produce cooled effluent 180. Effluent cooler 175 can be any type of heat exchanger capable of reducing the temperature of a mixed hydrocarbon and water stream. Examples of effluent cooler 175 include a shell and tube exchanger. The temperature of cooled effluent 180 can be between 35 deg C. and 150 deg C. Cooled effluent 180 can be introduced to effluent depressurizing device 185.

The pressure of cooled effluent 180 can be reduced in effluent depressurizing device 185 to produce depressurized effluent 190. Effluent depressurizing device 185 can be any type of unit capable of reducing the pressure of a mixed hydrocarbon and water stream. Examples of effluent depressurizing device 185 include a pressure control valve, a back-pressure control valve, and a capillary element. The pressure of depressurized effluent 190 can be in the range from between ambient pressure and 0.1 MPa. Depressurized effluent 190 can be introduced to separator 195.

Depressurized effluent 190 can be separated in separator 195 to produce liquid oxidation product 40 and gas oxidation product 50. Separator 195 can be any type of unit capable of separating a stream in a gas phase and a liquid phase. Examples of separator 195 include a flash drum and a simple vessel. Separation in separator 195 means the whole product stream from the reactor effluent is not transferred to supercritical upgrading unit 200. In at least one embodiment, a purge gas stream can be introduced to separator 195. Purge gas stream can contain an inert gas. Examples of the inert gas in purge gas stream can include nitrogen, helium, argon, and combinations of the same. Introducing a purge gas stream to separator 195 can enhance the separation of gases in depressurized effluent 190 from the liquids in depressurized effluent 190.

In at least one embodiment, cooled effluent 180 can be introduced to separator 195 without an intermediate depressurizing device. A purge stream, such as nitrogen gas, can be used in separator 195 to enhance the separation of the gas phase from the liquid phase. In such an embodiment, a pressure let down device can be located in the line withdrawing gas oxidation product 50 from separator 195.

Gas oxidation product 50 contains, gases formed in oxidation reactor 165, unreacted oxidants, water, and combinations of the same. The gases in gas oxidation product 50 can include carbon monoxide, carbon dioxide, light hydrocarbons and combinations of the same. Light hydrocarbons can include methane, ethane, butane, and combinations of the same. Advantageously, separating the depressurized effluent 190 into liquid oxidation product and gas oxidation product results in removing unreacted oxidants as part of the gas oxidation product. Removing unreacted oxidants is advantageous because oxidants in supercritical water can reduce liquid yield and can cause corrosion problems in supercritical upgrading unit 200.

Liquid oxidation product 40 contains heavy oil, oxygenates, water, and combinations of the same. In at least one embodiment, liquid oxidation product 40 is in the absence of oxidants. Liquid oxidation product 40 is in the absence of blown asphalt. The oxygenates can include organic oxygenates, where the organic oxygenates can be present in the water phase. The total oxygen to carbon molar ratio in liquid oxidation product 40 can be in the range between 0.005 and 0.1 and alternately in the range between 0.01 and 0.04.

Figure 3:
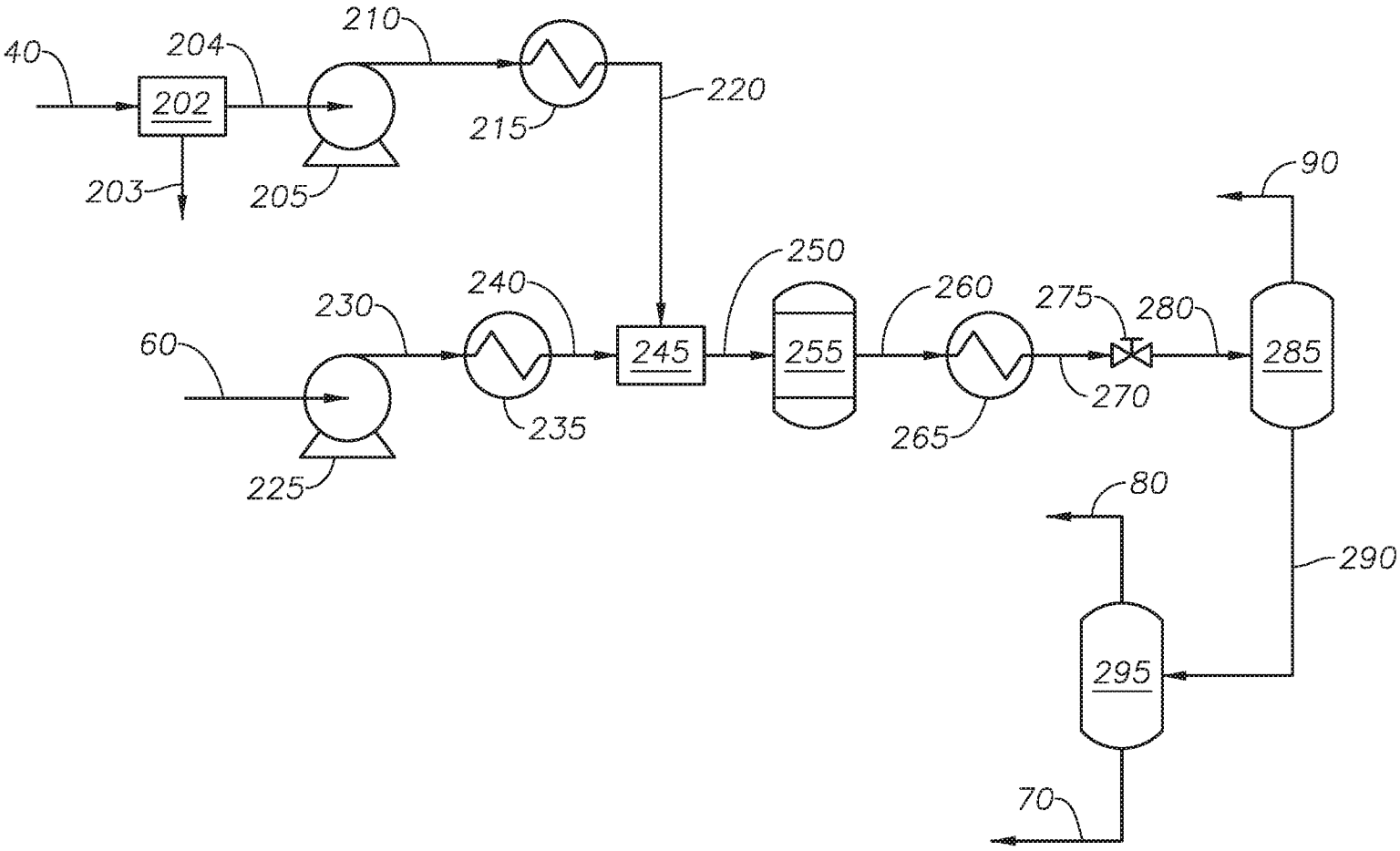
FIG. 3 provides a process diagram of an embodiment of the supercritical upgrading unit.

Supercritical upgrading unit 200 can be described in more detail with reference to FIG. 3.

Liquid oxidation product 40 can be passed to filter unit 202. Filter unit 202 can be any type of filtration unit capable of separating solid particles from a fluid stream. Filter unit 202 can include a filter. The solid particles can include metal compounds, coke, and combinations of the same. The metal compounds can include alkali, nickel, iron, vanadium, and combinations of the same. Filter unit 202 can separate solid particles with a size greater than 40 microns and alternately greater than 140 microns. Filter unit 202 can separate solid particles formed in partial oxidation unit 100 and solid particle present in heavy oil feed 10. The solid particles in liquid oxidation product 40 can be separated in filter unit 202 to produce solid waste 203 and filtered stream 204. Filtered stream 204 can be passed to pump 205.

The pressure of filtered stream 204 can be increased in pump 205 to produce pressurized stream 210. Pump 205 can be any type of pump capable of increasing the pressure of filtered stream 204. Examples of pump 205 include a metering pump, such as a diaphragm pump. The pressure of pressurized stream 210 can be greater than the critical pressure of water. Pressurized stream 210 can be introduced to heater 215.

The temperature of pressurized stream 210 can be increased in heater 215 to produce hot stream 220. Heater 215 can be any type of heat exchanger capable increasing the temperature of pressurized stream 210. Examples of heat exchangers capable of being used as petroleum heater 215 can include an electric heater, a fired heater, and a cross exchanger. The temperature of hot stream 220 can be less than 250 deg C., alternately less than 150 deg C., alternately between 10 deg C. and 250 deg C. and alternately between 50 deg C. and 150 deg C. Maintaining the temperature of hot stream 220 at less than 300 deg C. reduces the formation of coke hot stream 220 and in supercritical water reactor 255.

Water stream 60 can be passed to water pump 225. The pressure of water stream 60 can be increased in water pump 225 to produce pressurized water stream 230. Water pump 225 can be any type of pump capable of increasing the pressure of water stream 60. In at least one embodiment, water pump 225 is a metering pump, such as a diaphragm pump. The pressure of pressurized water stream 230 can be greater than the critical pressure of water. Pressurized water stream 230 can be introduced to water heater 235.

The temperature of pressurized water stream 230 can be increased in water heater 235 to produce supercritical water stream 240. Water heater 235 can be any type of heat exchanger capable of increasing the temperature of pressurized water stream 230. Examples of heat exchangers that can be used as water heater 235 can include an electric heater and a fired heater. The temperature of supercritical water stream 240 can be equal to or greater than the critical temperature of water, alternately between 374 deg C. and 550 deg C., and alternately between 400 deg C. and 450 deg C.

Hot stream 220 and supercritical water stream 240 can be passed to mixer 245. Mixer 245 can be any type of mixing device capable of mixing a petroleum stream and a supercritical water stream. Examples of mixing devices suitable for use as mixer 245 can include a static mixer, an inline mixer, such as tee fitting, and an impeller-embedded mixer. The ratio of the volumetric flow rate of hot stream 220 to supercritical water stream 240 can be determined based on the amount of water in liquid oxidation product 40. The ratio of the volumetric flow rate of supercritical water stream 240 to hot stream 220 can be in the range between 1.1:1 and 5:1 at standard temperature and pressure (SATP). Advantageously, while the volume of water in liquid oxidation product 40 can be sufficient to allow conversion reactions to occur in supercritical water reactor 255, the generation of supercritical water stream 240 can reduce the heat load in heater 215 while maintaining operating conditions in supercritical water reactor 255. Hot stream 220 and supercritical water stream 240 can be mixed to produce mixed stream 250. The pressure of mixed stream 250 can be greater than the critical pressure of water. The temperature of mixed stream 250 can depend on the temperature of supercritical water stream 240 and hot stream 220. Mixed stream 250 can be introduced to supercritical water reactor 255.

Supercritical water reactor 255 can include one or more reactors in series. Supercritical water reactor 255 can be any type of continuous-type reactor capable of allowing conversion reactions to occur. Examples of reactors suitable for use in supercritical water reactor 255 can include tubular-type, vessel-type, and combinations of the same. In at least one embodiment, supercritical water reactor 255 includes a tubular reactor, which advantageously prevents precipitation of reactants or products. Supercritical water reactor 255 can include an upflow reactor, a downflow reactor, and a combination of an upflow reactor and downflow reactor. In at least one embodiment, supercritical water reactor 255 includes an upflow reactor, which advantageously prevents channeling of reactants resulting in an increased reaction yield. In at least one embodiment, supercritical water reactor 255 is in the absence of an external supply of hydrogen. Supercritical water reactor 255 is in the absence of an external supply of catalyst. Operating supercritical water reactor 255 in the absence of an external supply of hydrogen, an external supply of catalyst, and removing gases and unreacted oxidants from gas oxidation product 50 can reduce the extent of overcracking in supercritical water reactor 255, overcracking of hydrocarbons can increase the amount of low economic value gases produced. Supercritical water reactor 255 is in the absence of an external supply of oxidants.

The temperature in supercritical water reactor 255 can be maintained at greater than the critical temperature of water, alternately in the range between 380 deg C. and 500 deg C., and alternately in the range between 400 deg C. and 450 deg C. The pressure in supercritical water reactor 255 can be maintained at a pressure greater than the critical pressure of water and alternately between 23 MPa and 27 MPa. The residence time of the reactants in supercritical water reactor 255 can between 1 minute and 120 minutes and alternately between 2 minutes and 10 minutes. The residence time is calculated by assuming that the density of the reactants in supercritical water reactor 255 is the same as the density of water at the operating conditions of supercritical water reactor 255.

The reactants in supercritical water reactor 255 can undergo conversion reactions to produce reactor product 260. In at least one embodiment, deoxygenation reactions, hydrolysis reactions, decarboxylation reactions, dehydration reactions, conversion reactions, and combinations of the same can occur in supercritical water reactor 255. Deoxygenation reactions can include reactions that transform carbonyl groups, such as those found in ketones, to carbon monoxide, reactions that transform carboxylic groups to carbon dioxide, and combinations of the same. In hydrolysis reactions, ethers can be transformed into alcohols and esters can be transformed into alcohols and aldehydes. In decarboxylation reactions, a carboxyl group can be removed from any oxygenate releasing carbon dioxide due to the presence of supercritical water. In dehydration reactions, alcohols can be transformed to olefins. In at least one embodiment, the alcohols formed in hydrolysis reactions can be converted to olefins in dehydration reactions in the supercritical water reactor. Advantageously, the carbon-oxygen bonds of the oxygenates can be broken in the supercritical water reactor, which can enhance the conversion reactions. In at least one embodiment, supercritical water reactor 255 is in the absence of oxidation reactions. Reactor product 260 can be introduced to product cooler 265.

The temperature of reactor product 260 can be reduced in product cooler 265 to produce cooled product 270. Product cooler 265 can be any type of heat exchange device capable of reducing the temperature of reactor product 260. Examples of product cooler 265 can include double pipe type exchanger and shell-and-tube type exchanger. The temperature of cooled product 270 can be between 10 deg C. and 200 deg C. and alternately between ambient temperature and 150 deg C. and alternately between 30 deg C. and 150 deg C. Cooled product 270 can be introduced to depressurizing device 275.

The pressure of cooled product 270 can be reduced to produce depressurized stream 280. Depressurizing device 275 can be any type of device capable of reducing the pressure of a fluid stream. Examples of depressurizing device 275 can include a pressure let-down valve, a pressure control valve, and a back pressure regulator. The pressure of depressurized stream 280 can be between atmospheric pressure and 0.1 MPa. Depressurized stream 280 can be introduced to vapor-liquid separator 285.

Vapor-liquid separator 285 can be any type of separation device capable of separating a fluid stream into gas phase and liquid phase. Depressurized stream 280 can be separated in vapor-liquid separator 285 to produce liquid stream 290 and gas product stream 90. Liquid stream 290 can be introduced to oil-water separator 295.

Oil-water separator 295 can be any type of separation device capable of separating a fluid stream into a hydrocarbon containing stream and a water stream. Liquid stream 290 can be separated in oil-water separator 295 to produce used water stream 70 and upgraded product stream 80. The conditions in oil-water separator 295 can be adjusted to control the amount of water in upgraded product stream 80.

Additional equipment, such as storage tanks, can be used to contain the feeds to each unit. Instrumentation can be included on the process lines to measure various parameters, including temperatures, pressures, and concentration of water.

EXAMPLES

Examples. The Example was conducted by a lab scale unit with a system as shown in FIGS. 1-3. Two runs were performed with a heavy oil feed. In both runs, heavy oil feed 10 was an atmospheric residue of Arabian light crude oil. And water feed 20 was a demineralized water having a conductivity of 0.055 μS/cm.

In the first run, the heavy oil feed was processed in a supercritical upgrading unit. Heavy oil 10 was passed through a metering pump, at a rate of 0.11 L/hr. The pressurized stream was heated to a temperature of 150 deg C. in an electric heater. Water stream 60 was fed by a metering pump at a rate of 0.11 L/hr. The temperature of the pressurized water stream was increased to 450 deg C. in an electric heater. The supercritical water stream was mixed with the hot stream in a ¼ inch tee fitting and the mixed stream was introduced to the supercritical reactor. The supercritical reactor was two reactors in series, each with a tubular reactor with a 160 ml internal volume and downward flow direction. The temperature in the first reactor was 400 deg C. and in the second reactor 430 deg C. The supercritical water reactor effluent was cooled to 85 deg C. and the cooled product was depressurized in a back pressure regulator. The pressure between the pumps and the depressurizing device was maintained at 27 MPa. The depressurized stream was introduced to a vapor-liquid separator with nitrogen at a flow rate of 100 sccm. The liquid stream was introduced to an oil-water separator with a demulsifier. The fluid was agitated for 2 hours at 60 deg C. and then allowed to settle for 48 hours, during which time the oil and water phases separated. Results are shown in Table 1.

In a second run, an upgrading process that included a partial oxidation unit and a supercritical upgrading unit was used as describe. In the second run, oxidant feed 30 was a hydrogen peroxide solution, containing 30 wt % hydrogen peroxide in water. The mix rate of water feed 20 and oxidant feed 30 result in mixed oxidant feed 130 have a concentration of oxidant of 0.2 wt %. Mixed oxidant feed 130 was stored in a tank and withdrawn from a high pressure metering pump at a rate of 0.13 L/hr. Heavy oil feed 10 was withdrawn from a storage tank at a temperature of 90 deg C. and pumped through a high pressure metering pump at a rate of 0.12 liter/hour (L/hr). Pressurized oxidant feed 140 was heated to a temperature of 400 deg C. in one heater and pressurized oil feed 110 was heated to a temperature of 400 deg C. in a separate heater. The residence time of pressurized oxidant feed 140 in feed heater 115 was about 10 seconds which was sufficient to decompose all of the hydrogen peroxide into water and oxygen.

Hot oil feed 120 and hot oxidant feed 150 are mixed in oxidation mixer 155, which was a ¼ tee fitting. Mixed oxidation feed 160 was introduced to oxidation reactor 165. Oxidation reactor 165 was a CSTR with a 0.3 liter internal volume and temperature maintained at 350 deg C. as measured by a dip tube-type thermocouple. Reactor effluent 170 was cooled in a double-pipe type cooler to 35 deg C. and cooled effluent 180 was depressurized in a back pressure regulator. The pressure from the pumps through effluent depressurizing device 185 was maintained at 22 MPa. Depressurized effluent 190 was flushed by flowing nitrogen at the rate of about 100 standard cubic centimeters per minute (sccm) to remove gas-phase products and oxygen. The remaining liquid-phase product was agitated by a rotating turbine at 500 revolutions per minute (rpms) for five hours. The liquid-phase product was agitated to prevent settling of solid particles, because suspended solid particles can be filtered more easily than solid particles that have settled.

The agitated fluid was filtered by filter unit 202, an inline filter having a 140 micron size and using a peristatic pump. Filtered stream 204 was stored in a storage tank having an agitator inside to produce a uniform oil-water distribution. Fluid was withdrawn from the storage tank and passed through pump 205, a metering pump, at a rate of 0.11 L/hr. Pressurized stream 210 was heated to a temperature of 150 deg C. in an electric heater. Water stream 60 was fed by water pump 225, a metering pump, at a rate of 0.11 L/hr. The temperature of pressurized water stream 230 was increased to 450 deg C. in an electric heater. Supercritical water stream 240 was mixed with hot stream 220 in a ¼ inch tee fitting and mixed stream 250 was introduced to supercritical reactor 255. Supercritical reactor 255 was two reactors in series, each with a tubular reactor with a 160 ml internal volume and downward flow direction. The temperature in the first reactor was 400 deg C. and in the second reactor 430 deg C. Reactor product 260 was cooled to 85 deg C. and cooled product 270 was depressurized in depressurizing device 275, a back pressure regulator. The pressure between the pumps and depressurizing device 275 was maintained at 27 MPa. Depressurized stream 280 was introduced to vapor-liquid separator 285 with nitrogen at a flow rate of 100 sccm. Liquid stream 290 was introduced to oil-water separator 295 with a demulsifier. The fluid was agitated for 2 hours at 60 deg C. and then allowed to settle for 48 hours, during which time the oil and water phases separated. Results are shown in Table 1.

TABLE 1

Properties of the Streams

| Property | Heavy Oil Feed 10 | Run 1 Liquid Product (Supercritical Upgrading Unit Only) | Run 2 Upgraded Product Stream (Oxidation Unit and Supercritical Upgrading Unit) |
|---|---|---|---|
| API Gravity | 13.8 | 18.6 | 24.3 |
| Sulfur Content (wt %) | 3.4 | 3.0 | 2.1 |
| Vanadium content (wt ppm) | 16 | 7 | 2 |
| Viscosity @ 122 deg F. (cSt) | 595 | 24 | 8 |
| Mass Yield (%) | 100 | 96.5 | 94.7% |
| Volume Yield (%) | 100 | 100 | 102%* |

*Due to density decrease, the volume is expanded

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

There various elements described can be used in combination with all other elements described here unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed here as from about one particular value to about another particular value and are inclusive unless otherwise indicated. When such a range is expressed, it is to be understood that another embodiment is from the one particular value to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made here.

As used here and in the appended claims, the words "comprise," "has," and "include" and all grammatical variations thereof are each intended to have an open, non-limiting meaning that does not exclude additional elements or steps.

That which is claimed is:

1. A process for upgrading a heavy oil, the process comprising the steps of:

introducing a heavy oil feed to a partial oxidation unit;

introducing a water feed to the partial oxidation unit, wherein the water feed comprises a demineralized water;

introducing an oxidant feed to the partial oxidation unit, where the oxidant feed comprises an oxidant, where a molar ratio of oxygen atoms in the oxidant feed to carbon atoms in the heavy oil feed is between 0.0007 and 0.05;

processing the heavy oil feed, the water feed, and the oxidant feed in the partial oxidation unit to produce a liquid oxidation product, where the liquid oxidation product comprises oxygenates in a water phase, wherein an oxidation reactor of the partial oxidation unit comprises a continuous-type reactor, wherein a temperature in the oxidation reactor is between 150 deg C. and 374 deg C. and a pressure in the oxidation reactor is between 0.5 MPa and 35 MPa such that the oxidation reactor is at subcritical conditions, wherein the oxygenates are produced in the oxidation reactor;

introducing the liquid oxidation product to a supercritical water unit, wherein the supercritical water unit comprises a supercritical water reactor, where a temperature of the supercritical water reactor is in the range between 380 deg C. and 500 deg C., where a pressure of the supercritical water reactor is in the range between 23 MPa and 27 MPa;

introducing a water stream to the supercritical water unit; and processing the liquid oxidation product and the water stream in the supercritical water unit to produce an upgraded product stream, the upgraded product stream comprising upgraded hydrocarbons relative to the heavy oil feed.

2. The process of claim 1, wherein the step of processing the heavy oil feed, the water feed, and the oxidant feed in the partial oxidation unit to produce the liquid oxidation product further comprises the steps of:

increasing the pressure of the heavy oil feed in a feed pump to produce pressurized oil feed;

introducing the pressurized oil feed to a feed heater;

increasing the temperature of the pressurized oil feed in the feed heater to produce a hot oil feed;

mixing the water feed and the oxidant feed in a premixer to produce a mixed oxidant feed;

introducing the mixed oxidant feed to an oxidant pump;

increasing the pressure of the mixed oxidant feed in the oxidant pump to produce a pressurized oxidant feed;

introducing the pressurized oxidant feed to an oxidant heater;

increasing the temperature of the pressurized oxidant feed to produce a hot oxidant feed;

mixing the hot oil feed and the hot oxidant feed in an oxidation mixer to produce a mixed oxidation feed, wherein the volumetric ratio of water to heavy oil in the mixed oxidation feed is in the range between 1:1 and 10:1 volume by volume at standard atmospheric temperature and pressure;

introducing the mixed oxidation feed to the oxidation reactor;

allowing the mixed oxidation feed to undergo oxidation reactions in the oxidation reactor to produce a reactor effluent;

introducing the reactor effluent to an effluent cooler;

reducing the temperature in the effluent cooler to produce a cooled effluent;

introducing the cooled effluent to an effluent depressurizing device;

decreasing the pressure of the cooled effluent in the effluent depressurizing device to produce a depressurized effluent;

introducing the depressurized effluent to a separator; and separating the depressurized effluent in the separator to produce a gas oxidation product and the liquid oxidation product, where the gas oxidation product comprises unreacted oxidants.

3. The process of claim 1, wherein the step of processing the liquid oxidation product and the water stream in the supercritical water unit to produce the upgraded product stream further comprises the steps of:

increasing the pressure of the liquid oxidation product in a pump to produce a pressurized stream;

introducing the pressurized stream to a heater;

increasing the temperature of the pressurized stream in the heater to produce a hot stream;

increasing the pressure of the water stream in a water pump to produce a pressurized water stream;

introducing the pressurized water stream to a water heater;

increasing the temperature of the pressurized water stream in the water heater to produce a supercritical water stream;

mixing the hot stream and the supercritical water stream in a mixer to produce a mixed stream;

introducing the mixed stream to the supercritical water reactor;

allowing the hydrocarbons to undergo a set of conversion reactions in the supercritical water reactor to produce a reactor product;

introducing the reactor product to a product cooler;

reducing the temperature of the reactor product to produce a cooled product;

introducing the cooled product to a depressurizing device;

reducing the pressure of the cooled product in the depressurizing device to produce a depressurized stream;

introducing the depressurized stream to a vapor-liquid separator to produce a gas product stream and a liquid stream;

introducing the liquid stream to an oil-water separator; and separating the liquid stream in the oil-water separator to produce the upgraded product stream and a used water stream.

4. The process of claim 1, where the heavy oil feed is selected from the group consisting of petroleum, coal liquid, or biomaterials, and combinations of the same.

5. The process of claim 1, where the oxidant is selected from the group consisting of air, oxygen gas, hydrogen peroxide, organic peroxides, and combinations of the same.

6. The process of claim 1, where the oxygenates are selected from alcohols, ketones, esters, ethers, carboxylic acids, and combinations of the same.

7. The process of claim 2, where the temperature of the oxidation reactor and the pressure is such that water in the oxidation reactor is present in the liquid phase.

8. The process of claim 2, where a liquid hourly space velocity in the oxidation reactor is in the range between 1 hr-1 and 10 hr-1.

9. The process of claim 2, where the oxidation reactor comprises an oxidation catalyst, where the oxidation catalyst comprises an active component.

10. The process of claim 3, where a ratio of a volumetric flow rate of the supercritical water stream to the hot stream is in the range between 1.1:1 and 5:1.

11. The process of claim 1, wherein the oxidation reactor is in the absence of an external supply of catalyst.

12. The process of claim 1, wherein the total oxygen to carbon molar ratio in the liquid oxidation product is in the range between 0.005 and 0.1.

* * * * *